US005540264A

United States Patent [19]

Harp

[11] Patent Number: 5,540,264

[45] Date of Patent: Jul. 30, 1996

[54] CONTAINER DRAIN SUPPORT AND FLUID COLLECTION APPARATUS

[76] Inventor: Timmy R. Harp, 5819 Bennett St., Loves Park, Ill. 61111

[21] Appl. No.: 408,862

[22] Filed: Mar. 23, 1995

[51] Int. Cl.[6] ..... B65B 1/04; B65B 3/04

[52] U.S. Cl. ..... 141/106; 141/366; 141/379; 141/231

[58] Field of Search ..... 141/106, 105, 141/107, 279, 284, 332, 337, 339, 340, 341, 363, 364, 365, 366, 369, 375, 379, 391, 231

[56] References Cited

U.S. PATENT DOCUMENTS

| | | | |
|---|---|---|---|
| D. 330,147 | 10/1992 | Garber | D7/619 |
| 637,963 | 11/1899 | Howard | 141/332 |
| 1,411,812 | 4/1922 | Smith | 141/363 |
| 2,182,681 | 12/1939 | Seibel | 141/341 |
| 3,615,150 | 10/1969 | Indrunas | 141/375 |
| 3,908,952 | 9/1975 | Von Alven | 248/360 |
| 4,496,124 | 1/1985 | Cole | 248/146 |
| 5,002,246 | 3/1991 | Chaffin et al. | 248/153 |
| 5,381,839 | 1/1995 | Dowd | 141/340 |

*Primary Examiner*—Henry J. Recla
*Assistant Examiner*—Steven O. Douglas
*Attorney, Agent, or Firm*—David L. Baker; Rhodes & Ascolillo

[57] ABSTRACT

An apparatus for collecting fluids has a base member, a container support member, a fluid conduit platform on the container support member and a plurality of telescoping leg members connecting the base member to the fluid conduit platform. A support extension is on the base member. A plurality of flexible headers is removably inserted through a plurality of ports in the fluid conduit platform. A container chamber is removably connected to each of the flexible headers. The container chamber has an anti-contaminant cover hingedly attached thereon. A flow pipe is connected to each the headers and a flow manifold is connected to the flow pipes. A transfer valve is connected to one end of the flow manifold. A flexible flow direction pipe releasibly connects to the transfer valve. A plurality of wheel gear access ports is in the base member. A wheel gear member is in each of the plurality of wheel gear access ports and a hinge plate is on each of the wheel gear members. A locking extension is on the hinge plate. A wheel lock member, on each of the wheel gear members selectively unlocks and moves the wheel gear member from a lock-up position and selectively moves and locks the wheel gear member to a lock-down position.

8 Claims, 6 Drawing Sheets

FIG. 3
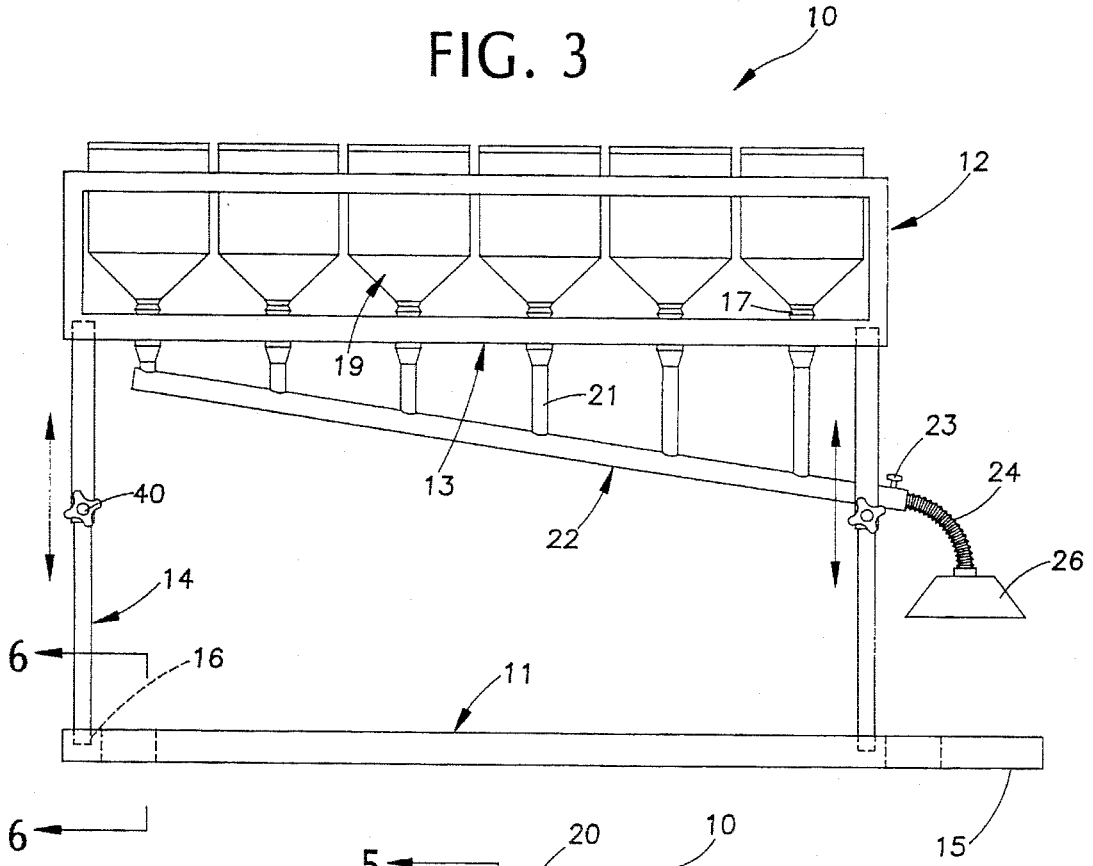
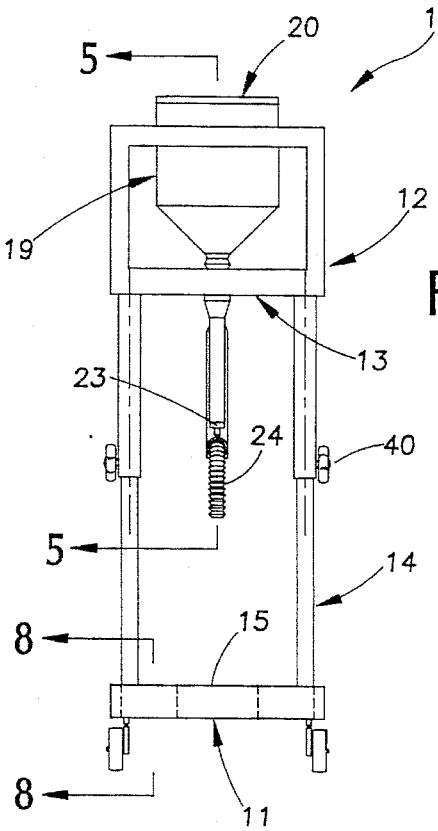
FIG. 4

CONTAINER DRAIN SUPPORT AND FLUID COLLECTION APPARATUS

BACKGROUND OF THE INVENTION

1. Field of the Invention

This invention relates to a portable and adjustable support for multiple containers to allow their contents to be drained into a collection reservoir.

2. Description of the Related Art

U.S. Pat. No. 3,615,150 to W. G. Indrunas on Oct. 26, 1971 for a Means for Draining Catsup Bottles shows a two bottle support, pivoted upon a balance bar, allowing the mouths of the two bottles to engage and communicate the contents of one bottle to another when one bottle is raised above the other.

U.S. Pat. No. 3,908,952 to R. D. Van Alven on Sept. 30, 1975 for a Container Support describes a flexible extensible net that encompasses a bottle to support and restrain the bottle to allow the contents of the bottle to drain once the bottle is hung upside down from a suitable support arm.

U.S. Pat. No. 14,496,124 to G. Cole on Jan. 29, 1985 for a Bottle Support shows a two-part support for storing a bottle of wine at an angle.

U.S. Pat. No. 5,002,246 to M. G. Chaffin, et al., on Mar. 26, 1991 for a Container Drain Support describes a wire rack providing for a bottle to be supported at an angle and drained into another container.

U.S. Pat. No. Des. 330,147 to H. P. Garber on Oct. 13, 1992 shows molded plastic support having an impression into which a bottle is placed at an angle to allow the contents of the bottle to drain.

SUMMARY OF THE INVENTION

Over the years many attempts have been made to salvage fluids, such as oil, from the containers in which they are sold. In today's hurried times, a business that removes and replaces the oil and other fluids in motor vehicles does not have enough time to completely drain all the fluid from a container. In the past, the fluid remained in the container and was thrown out with the container. Today, not only is such waste costly, it is environmentally unsound. Various environmental laws may make the disposing of the remaining oil improperly a legal problem for the business. Because of this, many firms have tried to drain the oil from individual cans. This often led to many containers lying around for their turn to be drained. As they sat on the floor, contaminants entered into the fluid lessening their value. Often times the containers were knocked over creating a cleaning problem if not a hazard.

The present invention solves many of these problems. With the present invention, multiple containers may be drained at the same time in the same convenient apparatus. One row of a multiple row of container chambers may be used for one fluid and another row used for another fluid or if only one fluid is drained one or more rows can be used to drain many containers of the same fluid. The stand is sturdy and may be easily moved. The present invention reduces the amount of contaminants entering the fluid drained from the opened containers by use of a contaminant cover over the container chambers and by providing enclosed flow transfer headers and manifolds and a cover over the receiving storage container. The flow from the manifold may be turned off at will thus keeping the fluids from pooling on the floor when the receiving container is changed.

In one aspect of the present invention, an apparatus for collecting fluids is shown that has a base member and a container support member. There is a support extension on the base member to support the storage and transport container. There is a fluid conduit platform on the container support member. A plurality of leg members connect the base member to the fluid conduit platform. A flexible header is removably inserted through a port in the fluid conduit platform. A container chamber is removably connected to the at least one flexible header. There is a flow pipe connected to the flexible header. A flow manifold is connected to the flow pipe and a transfer valve is connected to one end of the flow manifold. A flexible flow direction pipe is releasibly connected to the transfer valve. There is a plurality of wheel gear access ports in the base member. The plurality of leg members may be telescoping and may have a leg locking mechanism. The container chamber may have an anti-contaminant cover hingedly attached.

In another aspect of the present invention, an apparatus for collecting fluids is shown that has a base member, a container support member and a fluid conduit platform on the container support member. A plurality of leg members connect the base member to the fluid conduit platform. A plurality of flexible headers is removably inserted through a plurality of ports in the fluid conduit platform. There is a container chamber removably connected to each of the flexible headers. A flow pipe connected to each the flexible headers and a flow manifold is connected to the flow pipes. There is a transfer valve connected to one end of the flow manifold and a flexible flow direction pipe is releasibly connected to the transfer valve. There is a support extension on the base member.

There may be a plurality of wheel gear access ports in the base member and a wheel gear member in each of the plurality of wheel gear access ports. There may be a wheel lock member on each of the wheel gear members to selectively unlock and move the wheel gear member from a lock-up position and to move and lock the wheel gear member to a lock-down position. A wheel pivot mechanism may be on at least two of the wheel gear members. The plurality of leg members may be telescoping and may have a leg locking mechanism. The container chamber may have an anti-contaminant cover hingedly attached.

It is an object of this invention to provide a container drain support and fluid collection apparatus that will drain one or more partially empty containers and be easily moved from one location to another.

It is also an object of this invention to provide a container drain support and fluid collection apparatus that will reduce the amount of contaminants entering the drained fluid as it proceeds to the containment and transfer container.

BRIEF DESCRIPTION OF THE DRAWINGS

FIG. 3 is a right side elevational view of the first embodiment.

FIG. 4 is a front elevational view.

DESCRIPTION OF THE PREFERRED EMBODIMENT

Figure 1:
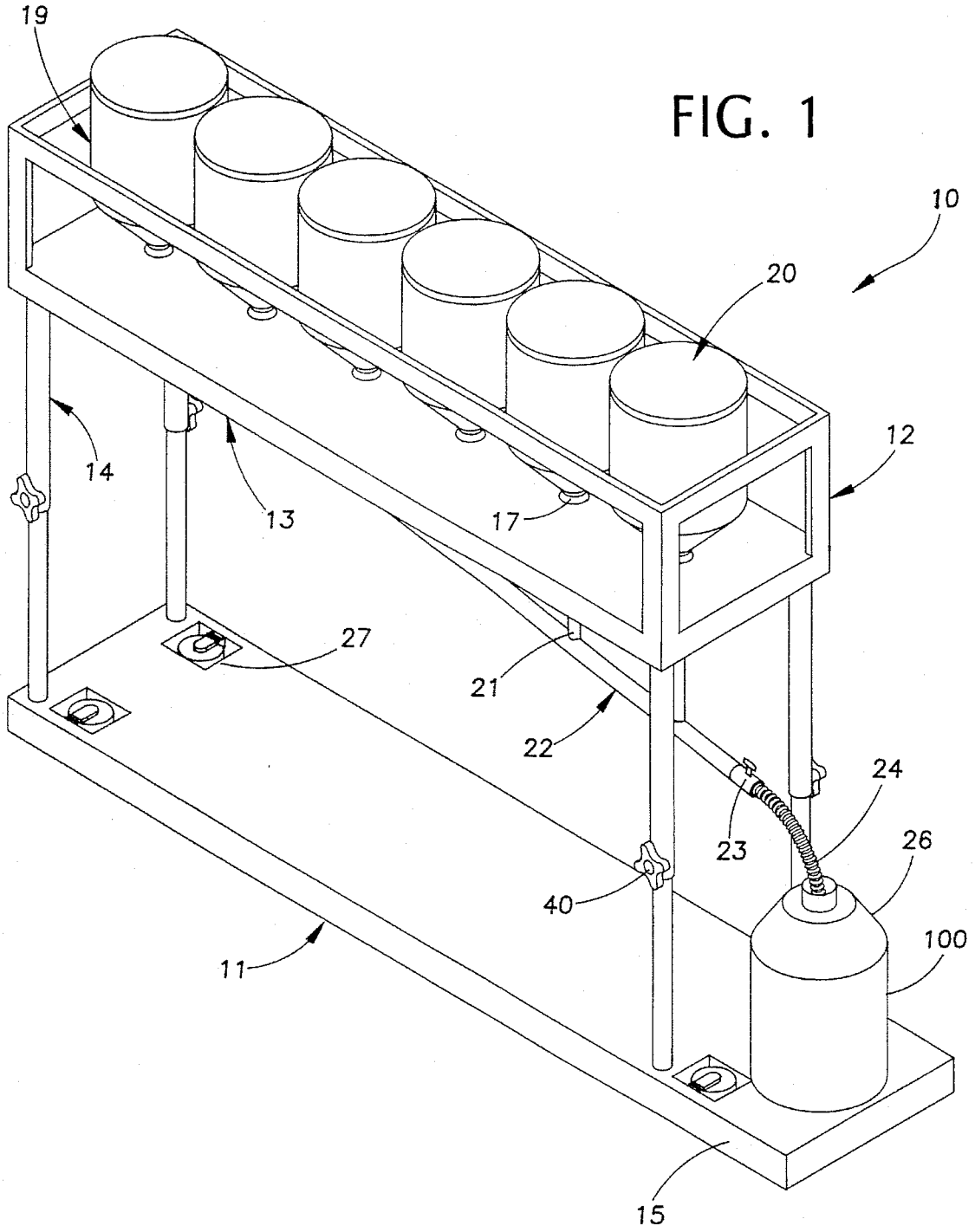
FIG. 1 is a perspective view of a first embodiment of the Container Drain Support and Fluid Collection Apparatus.

Referring to FIGS. 1 through 8, an apparatus 10 for collecting fluids is shown and described that has a base member 11, a container support member 12, a fluid conduit platform 13 on the container support member 12 and a plurality of telescoping leg members 14 connecting the base member 11 to the fluid conduit platform 13. There is a support extension 15 on the base member 11 to support a storage and transfer container 100. The base 11, container support member 12, fluid conduit platform 13 and leg members 14 could be made of wood, metal or plastic and formed by known methods such as cutting to size, stamping, drawing or molding. The various parts of the above could be attached by adhesives and/or fasteners and the legs could be threaded into threaded ports 16 in the base 11 and in fluid conduit platform 13.

A plurality of flexible headers 17 is removably inserted through a plurality of ports 18 in the fluid conduit platform 13. A container chamber 19 is removably connected to each of the flexible headers 17. The container chamber 19 has an anti-contaminant cover 20 hingedly attached thereon. There is a flow pipe 21 connected to each the flexible headers 17 and a flow manifold 22 connected to the flow pipes 21. A transfer valve 23 is connected to one end of the flow manifold 22. A flexible flow direction pipe 24 releasibly connects to the transfer valve 23. The flow direction pipe 24 usually drains into a suitable container 100 for transport and storage of the fluids. The flexible headers 17 may be made of plastic such as is found used on flexible straws or metal such as is found used on flexible funnels. All ports may be drilled or formed in the molding or stamping process. The container chambers 19 may be made of plastic or metal as are the covers that cover the top of the container chambers. The hinges 25 on the container chambers 19 and covers 20 may be thin membrane hinges or plastic or metal hinges attached to the cover 20 and to the container chamber by suitable fasteners. The flow pipes 21, flow manifold 22 and transfer valve 23 will preferably be made of PVC pipe or the equivalent but could be made of metal. The flexible flow direction pipe 24 could be made of plastic or a synthetic material such as is found in oil resistant hose. There may be a contaminant hood 26 removably attached to the flexible flow direction pipe 24 to reduce the amount of contaminants entering the storage and transport container 100.

There is a plurality of wheel gear access ports 27 in the base member 11. There is a wheel gear member 28 in each of the plurality of wheel gear access ports 27 and a hinge plate 29 on each of the wheel gear members 28. The wheels 30 in the wheel gear members 28 are commonly found in the marketplace. The hinge plates 29, preferably metal, are removably attached, by suitable fasteners, to an inside wall 31 of the wheel gear access ports 27. There is a locking extension 32 on the hinge plate 29. A wheel lock member 33 (preferably made of metal), on each of the wheel gear members 28 selectively unlocks and moves the wheel gear member 28 from a lock-up position (shown in FIG. 6) and selectively moves and locks the wheel gear member 28 to a lock-down position (shown in FIG. 7). The wheel lock member 33, on each of the wheel gear members 28 also selectively unlocks and moves the wheel gear member 28 from a lock-down position (shown in FIG. 7) and selectively moves and locks the wheel gear member to a lock-up position (shown in FIG. 6).

A lock cylinder 34, made preferably of metal, is attached to the hinge plate 29 and there is/are a spring-loaded pin(s) 35 in the lock cylinder 34. There is a pin actuation member 36 on the pin(s) 35 and a lock-up port 37 in the locking extension 32. There is a lock-down port 38 in the locking extension 32. A wheel pivot mechanism 39, attached to the hinge plate 29, on at least two of the wheel gear members 28. There is a leg locking mechanism 40 on the telescoping legs 14 to lock them in place.

Figure 2:
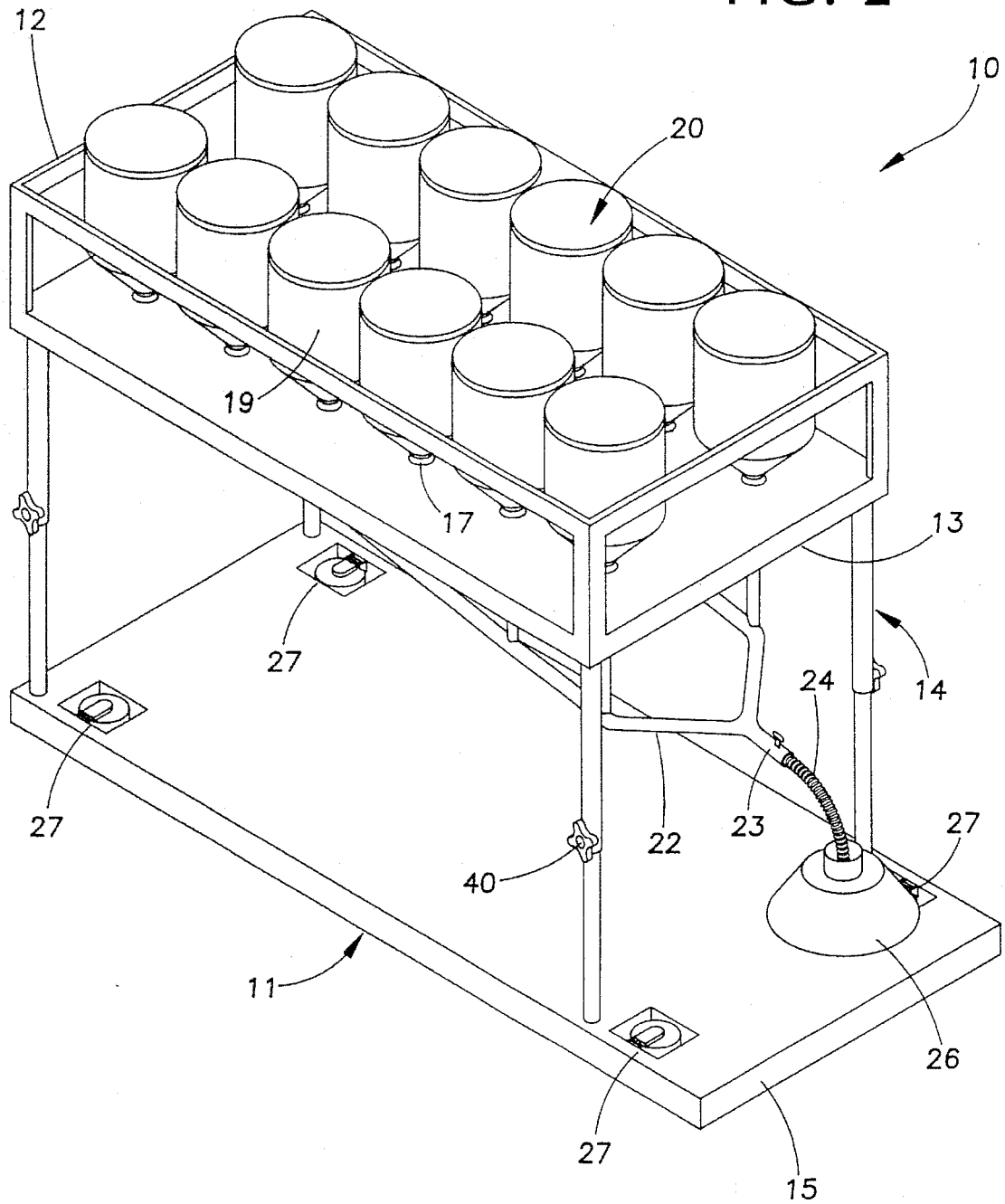
FIG. 2 is a perspective view of a second embodiment of the Container Drain Support and Fluid Collection Apparatus showing a plurality of rows of container chambers.
Figure 5:
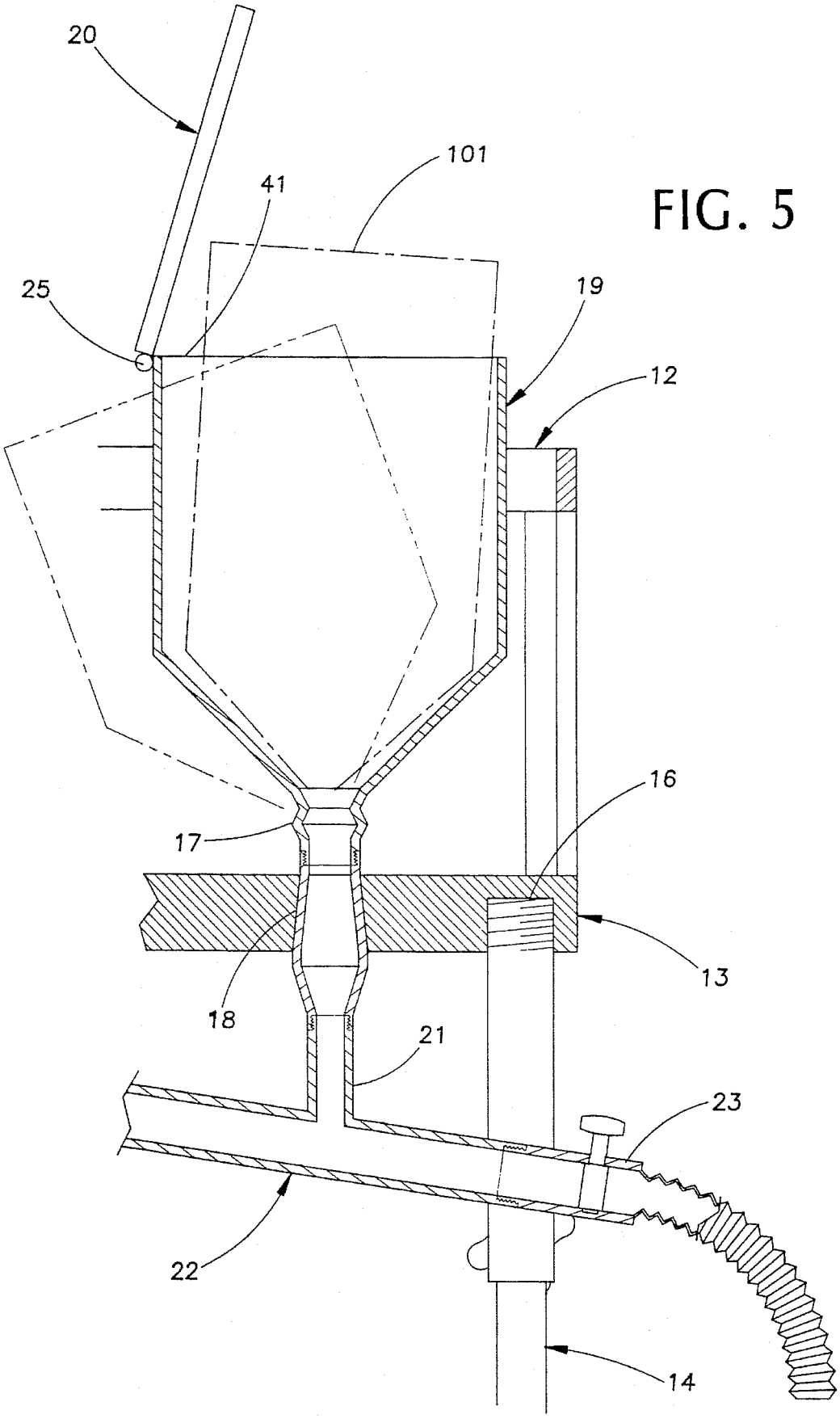
FIG. 5 is an enlarged fragmentary cross-sectional view, taken along line 5—5 of FIG. 4, of a container engaged in the fluid collection apparatus.
Figure 6:
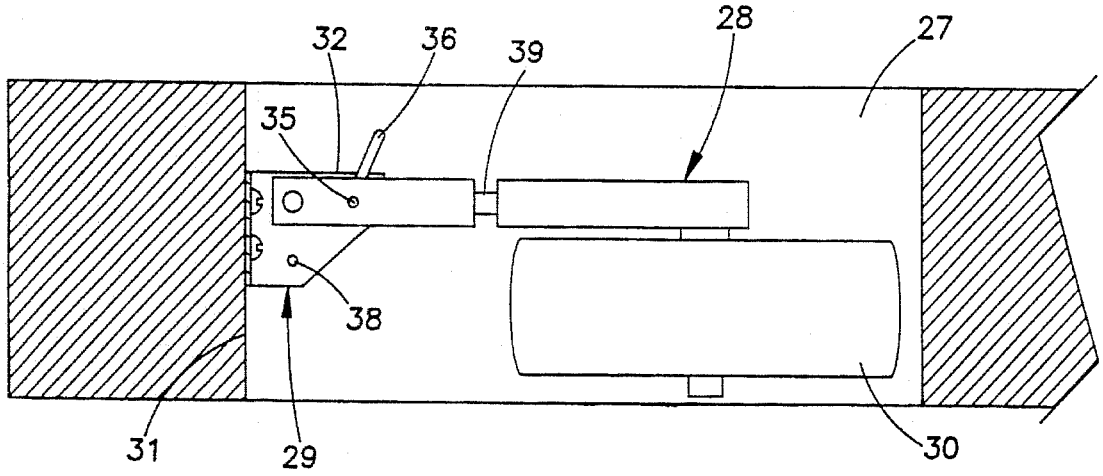
FIG. 6 is an enlarged fragmentary cross-sectional front elevational view, taken along line 6—6 of FIG. 3, of a folding wheel gear in the gear-up position.
Figure 7:
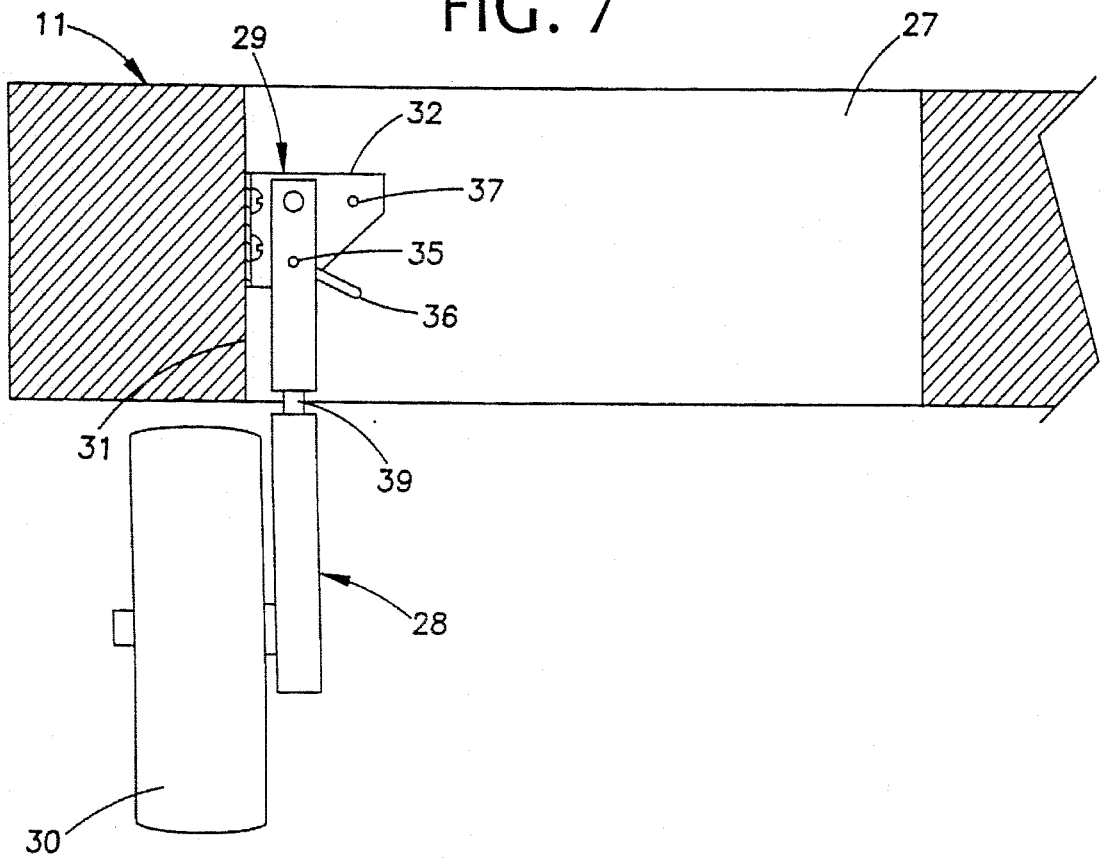
FIG. 7 is an enlarged fragmentary cross-sectional front elevational view of the folding wheel gear in the gear-down position.

In operation, There may be one or two rows of container chambers 19 with corresponding headers 17, flow pipes 21 and manifolds 22 converging into a single flow direction pipe 24 (see FIG. 2). But it could be foreseen that more than two rows of container chambers 19, headers 17 and manifolds 22 along with their supporting members could be used. More that one suitable container 100 for receiving the drained fluid might be needed especially if a different kind of fluid is being drained into one row of container chambers 19 than is being drained into another row.

A cover 20 is hinged back to allow a fluid container 101 to be placed within the container chamber 19. The container chamber 19 may be moved into different positions (see FIG. 5) to accommodate placing the container 101 to be drained into container chamber 19. The fluid to be saved drains from its container 101 into the container chamber 19, through the flexible headers 17, the flow pipe 21, into the flow manifolds 22 to the transfer valve 23. If the transfer valve, a ball valve or the like, is open, the fluid flows into the flow direction pipe 24 and into an awaiting container 100. Once that container 100 is full or a different fluid is to be drained, the valve 23 is closed and a new container 100 is placed beneath the flow direction pipe 24. If there is a need to clean the system, a suitable solvent may be poured into each of the container chambers 19 and the system flushed until clean. During the time when no fluid is being drained into a container chamber 19, the covers 20 is placed over the top 41 of the container chambers 19 and contaminants are therefore kept out of the container chambers.

Figure 8:
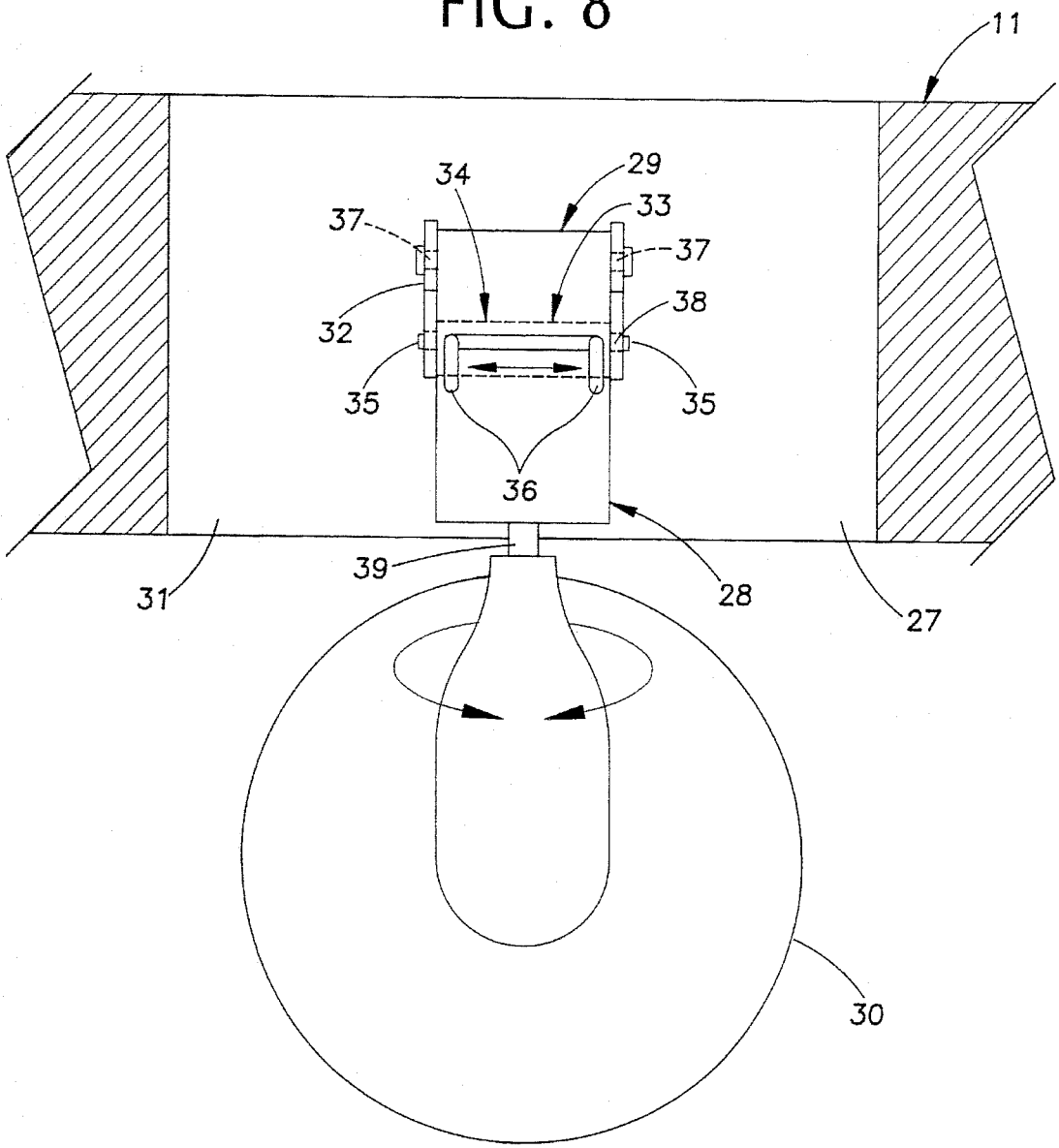
FIG. 8 is an enlarged fragmentary cross-sectional left side elevational view, taken along line 8—8 of FIG. 4, of the folding wheel gear in the gear-down position.

If it is desired to move the support 10, the base 11 may be lifted, the wheel gear members 28 unlocked from the gear up position by squeezing the two pin actuation members 36 together as shown in FIG. 8. This withdraws the pins 35 from the lock-up locking ports 37. The user then pushes the wheel gear 30 down until the spring-loaded locking pins 35 (biased into the lock position) enter the lock-down locking ports 38 and positions the wheel gear 30 in the lock down position. This is done for all the wheel gears. When the support 10 is in its new position, the sequence is reversed.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. An apparatus for collecting fluids from at least one container comprising:

(a) a base member;

(b) a container support member;

(c) a fluid conduit platform attached to the container support member having at least one port therein;

(d) a plurality of leg members connecting the base member to the fluid conduit platform;

(e) a flexible header removably inserted through each of said at least one port in the fluid conduit platform;

(f) a container chamber adapted to receive an inverted container removably connected to each said flexible header;

(g) a flow pipe connected to each said header;

(h) a flow manifold connected in fluid communication with each flow pipe;

(i) a transfer valve connected to one end of the flow manifold;

(j) a flexible flow direction pipe releasibly connected in fluid communication to the transfer valve;

(k) a support extension integral with the base member to support a container to receive fluid exiting said flexible flow direction pipe; and (l) a plurality of wheel gear access ports in the base member.

2. An apparatus for collecting fluids as described in claim 1 wherein the plurality of leg members further comprise being telescoping and having a leg locking mechanism.

3. An apparatus for collecting fluids as described in claim 1 wherein each said container chamber further comprises having an anti-contaminant cover hingedly attached thereto.

4. An apparatus for collecting fluids from at least one container comprising:

(a) a base member;

(b) a container support member;

(c) a fluid conduit platform attached to the container support member having a plurality of ports therein;

(d) a plurality of leg members connecting the base member to the fluid conduit platform;

(e) a flexible header removably inserted through each said plurality of ports in the fluid conduit platform;

(f) a container chamber adapted to receive an inverted container removably connected to each of the flexible headers;

(g) a flow pipe connected to each said flexible headers;

(h) a flow manifold connected in fluid communication with each flow pipe;

(i) a transfer valve connected to one end of the flow manifold;

(j) a flexible flow direction pipe releasibly connected in fluid communication to the transfer valve;

(k) a support extension integral with the base member to support a container to receive fluid exiting said flexible flow direction pipe; and (l) a plurality of wheel gear access ports in the base member.

5. An apparatus for collecting fluids as described in claim 4 further comprising:

(a) a wheel gear member disposed in each of the plurality of wheel gear access ports;

(b) a wheel lock member on each of the wheel gear members to selectively unlock and move the wheel gear member from a lock-up position and to move and lock the wheel gear member to a lock-down position; and (c) a wheel pivot mechanism on at least two of the wheel gear members.

6. An apparatus for collecting fluids as described in claim 4 wherein the plurality of leg members further comprise being telescoping and having a leg locking mechanism.

7. An apparatus for collecting fluids as described in claim 4 wherein each said container chamber further comprises having an anti-contaminant cover hingedly attached thereto.

8. An apparatus for collecting fluids from at least one container comprising:

(a) a base member;

(b) a container support member;

(c) a fluid conduit platform attached to the container support member having a plurality of ports therein;

(d) a plurality of telescoping leg members connecting the base member to the fluid conduit platform;

(e) a flexible header removably inserted through each said plurality of ports in the fluid conduit platform;

(f) a container chamber adapted to receive an inverted container removably connected to each of the flexible headers, comprising an anti-contaminant cover hingedly attached thereon;

(g) a flow pipe connected to each said flexible headers;

(h) a flow manifold connected in fluid communication with each flow pipe;

(i) a transfer valve connected to one end of the flow manifold;

(j) a flexible flow direction pipe releasibly connected in fluid communication to the transfer valve;

(k) a contaminant hood removably attached to the flexible flow direction pipe;

(l) a support extension integral with the base member to support a container to receive fluid exiting said flexible flow direction pipe;

(m) a plurality of wheel gear access ports in the base member;

(n) a wheel gear member disposed in each of the plurality of wheel gear access ports;

(o) a hinge plate connected to each wheel gear member;

(p) a locking extension connected to each hinge plate;

(q) a wheel lock member connected to each locking extension to selectively unlock and allow movement of the wheel gear member from a lock-up position and to move and lock the wheel gear member to a lock-down position, comprising:
a lock cylinder attached to the hinge plate;
a spring-loaded pin in the lock cylinder;
a pin actuation member connected to the pin;
a lock-up port in the locking extension; and
a lock-down port in the locking extension; and (r) a wheel pivot mechanism, attached to the hinge plate, on at least two of the wheel gear members.

* * * * *